US006435666B1

(12) United States Patent
Trauernicht et al.

(10) Patent No.: US 6,435,666 B1
(45) Date of Patent: Aug. 20, 2002

(54) THERMAL ACTUATOR DROP-ON-DEMAND APPARATUS AND METHOD WITH REDUCED ENERGY

(75) Inventors: David P. Trauernicht, Rochester; John A. Lebens, Rush, both of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/976,922

(22) Filed: Oct. 12, 2001

(51) Int. Cl.[7] ..... B41J 2/04
(52) U.S. Cl. ..... 347/54
(58) Field of Search ..... 347/54, 56, 61, 347/65, 70, 75

(56) References Cited

U.S. PATENT DOCUMENTS

| | | | | |
|---|---|---|---|---|
| 3,747,120 A | * | 7/1973 | Stemme | 347/70 |
| 3,946,398 A | | 3/1976 | Kyser et al. | 347/70 |
| 4,296,421 A | | 10/1981 | Hara et al. | 347/48 |
| 4,513,299 A | | 4/1985 | Lee et al. | 347/15 |
| 4,577,201 A | | 3/1986 | Murakami et al. | 347/68 |
| 5,170,177 A | | 12/1992 | Stanley et al. | 347/11 |
| 5,202,659 A | | 4/1993 | DeBonte et al. | 347/11 |
| 5,361,084 A | | 11/1994 | Paton et al. | 347/15 |
| 5,599,695 A | | 2/1997 | Pease et al. | 435/91.1 |
| 5,689,291 A | | 11/1997 | Tence et al. | 347/10 |
| 5,771,882 A | | 6/1998 | Psaros et al. | 128/203.12 |
| 5,801,732 A | | 9/1998 | Pengelly | 347/70 |
| 5,902,648 A | | 5/1999 | Naka et al. | 427/558 |
| 6,067,797 A | | 5/2000 | Silverbrook | 60/528 |
| 6,102,512 A | | 8/2000 | Torii et al. | 347/10 |
| 6,234,609 B1 | | 5/2001 | Silverbrook | 347/54 |
| 6,239,821 B1 | | 5/2001 | Silverbrook | 347/54 |
| 6,254,793 B1 | | 7/2001 | Silverbrook | 216/27 |
| 6,274,056 B1 | | 8/2001 | Silverbrook | 347/54 |

FOREIGN PATENT DOCUMENTS

| | | | |
|---|---|---|---|
| JP | 2030543 | 1/1990 | B41J/2/045 |

* cited by examiner

*Primary Examiner*—John Barlow
*Assistant Examiner*—Juanita Stephens
(74) *Attorney, Agent, or Firm*—Stephen F. Pond; Milton S. Sales

(57) ABSTRACT

An apparatus and method of operating a liquid drop emitter, such as an ink jet device, for emitting a series of liquid drops using reduced energy, is disclosed. The method is applicable to a drop emitter comprising a liquid-filled chamber having a nozzle and an actuator, such as a thermal actuator, for applying pressure to liquid at the nozzle. The actuator has a movable portion and exhibits damped resonant oscillation having a fundamental period, $T_R$, and a damping time constant, $T_D$. Apparatus adapted to cause rapid displacement of the movable portion of the actuator in response to electrical pulses causes drop ejection and damped resonant oscillation of the thermal actuator. The method of operating comprises applying electrical pulses having a nominal energy if the actuator is quiescent or applying reduced energy pulses to the actuator if it is usefully oscillating due to a previous drop emission. By advantageous use of resonant oscillations of the actuator, overall energy usage is reduced, and the productivity of the drop emitter is increased.

48 Claims, 12 Drawing Sheets

| W(μm) | L(μm) | D(μm) | F(KHz) | $T_R$(μsec) | $T_D$(μsec) | $T_D/T_R$ |
|---|---|---|---|---|---|---|
| 15 | 115 | 45 | 36.6 | 27.32 | 14.40 | 0.53 |
| 20 | 115 | 45 | 42.7 | 23.42 | 15.80 | 0.67 |
| 30 | 115 | 45 | 50.3 | 19.88 | 17.80 | 0.90 |
| 15 | 115 | 35 | 51.4 | 19.46 | 13.40 | 0.69 |
| 25 | 115 | 40 | 53 | 18.87 | 16.00 | 0.85 |
| 15 | 115 | 30 | 60 | 16.67 | 11.70 | 0.70 |
| 30 | 95 | 45 | 65.6 | 15.24 | 11.00 | 0.72 |
| 25 | 95 | 40 | 71.6 | 13.97 | 10.00 | 0.72 |
| 30 | 95 | 40 | 74 | 13.51 | 10.40 | 0.77 |

THERMAL ACTUATOR DROP-ON-DEMAND APPARATUS AND METHOD WITH REDUCED ENERGY

FIELD OF THE INVENTION

The present invention relates generally to drop-on-demand liquid emission devices, and, more particularly, to ink jet devices which employ thermo-mechanical actuators.

BACKGROUND OF THE INVENTION

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electroresistive heaters to generate vapor bubbles which cause drop emission, as is discussed by Hara et al., in U.S. Pat. No. 4,296,421.

Electroresistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed which can be used with a broad range of liquid formulations. Apparatus and methods are needed which combines the advantages of microelectronic fabrication used for thermal ink jet with the liquid composition latitude available to piezo-electro-mechanical devices.

A DOD ink jet device which uses a thermo-mechanical actuator was disclosed by T. Kitahara in JP 2030543, published Jan. 31, 1990. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently, disclosures of a similar thermo-mechanical DOD ink jet configuration have been made by K. Silverbrook in U.S. Pat. Nos. 6,067,797; 6,234,609; and 6,239,821. Methods of manufacturing thermo-mechanical ink jet devices using microelectronic processes have been disclosed by K. Silverbrook in U.S. Pat. Nos. 6,254,793 and 6,274,056.

Thermo-mechanically actuated drop emitters are promising as low cost devices which can be mass produced using microelectronic materials and equipment and which allow operation with liquids that would be unreliable in a thermal ink jet device. However, operation of thermal actuator style drop emitters, at high drop repetition frequencies, requires careful attention to excess heat build-up. The drop generation event relies on creating a pressure impulse in the liquid at the nozzle. A significant rise in baseline temperature of the emitter device, and, especially, of the thermo-mechanical actuator itself, precludes system control of a portion of the available actuator displacement that can be achieved without exceeding maximum operating temperature limits of device materials and the working liquid itself. Apparatus and methods of operation for thermo-mechanical DOD emitters are needed which manage heat build-up so as to maximize the productivity of such devices.

The present invention provides for emitting drops by reducing the thermal energy input when groups of drops or certain series of drops are required by the application. A damped resonant oscillation of the thermal actuator itself is required to implement the present invention.

Use of fluid resonances is known for piezoelectric drop-on-demand ink jet devices. In these known methods, the resonance of the ink meniscus at the nozzle, driven by surface tension effects, or the Helmholtz resonance of the ink chamber, driven by compliance effects, is used to change the volume or number of emitted drops. Tence et al. in U.S. Pat. No. 5,689,291 employ waveforms that drive piezoelectric transducers with spectral energy concentrations at frequencies associated with modal resonances of ink in the ink jet printhead orifices. Exciting different resonance modes of the ink meniscus causes the emission of different drop sizes.

Paton et al., in U.S. Pat. No. 5,361,084, disclose a method of multi-tone printing using a piezoelectric DOD printhead having elongated ink chambers and sidewall actuators, wherein an individual jet is excited using a packet of pulses so as to excite a longitudinal acoustic resonance in the jet channel which causes the emission of a number of discrete drops. Lee et al., in U.S. Pat. No. 4,513,299 disclose a similar use of acoustic resonance of the ink channels of a piezoelectric ink jet printhead.

DeBonte et al., in U.S. Pat. No. 5,202,659, disclose a method of operating a piezoelectric printhead using the dominant resonant frequency of the ink jet apparatus. In the specific examples disclosed, this dominant resonance is described as the Helmholtz resonance of an individual jet chamber which is excited by actuating the piezo transducer to first expand the jet chamber, waiting the resonance period, and then contracting the chamber to reinforce this resonance. This excitation process is repeated for multiple cycles to generate multiple merging drops for printing spots having different sizes. The methods disclosed by DeBonte, et al., operate by exciting bulk fluid mechanical resonances which are appropriate for physically large piezoelectric devices but are not useful for drop emitter chambers fabricated with dimensions of less than a few hundred microns. Helmholtz and other fluid mechanical resonances occur at frequencies too high to support multiple drop formation when fluid path dimensions are less than 1 mm.

Other piezoelectric ink jet inventors discourage using fluid mechanical resonances when uniformity of drop volume and velocity are important. Stanley et al., in U.S. Pat. No. 5,170,177 discloses a method of operating a piezo DOD device wherein the electrical pulses are adjusted to minimize their energy content at a frequency corresponding to the dominant acoustic frequency of the ink jet in order to accelerate drop break-off, optimize drop shape and minimize drop speed variations. Disclosures by Murakami et al., in U.S. Pat. No. 4,577,201 and Torii et al., in U.S. Pat. No. 6,102,512 also teach avoidance of Helmholtz and other fluid mechanical resonances in order to achieve uniform drop volume and velocity performance. Further, Pengelly in U.S. Pat. No. 5,801,732 discloses drop volume and velocity non-uniformities caused by exciting piezo transducer resonances in an ink jet printhead and a timing method for reducing these effects.

Thermo-mechanical DOD emitters are needed which reduce energy input and waste heat build-up so as to allow maximum net drop emission frequencies. The present invention makes use of a damped resonance oscillation of the thermal actuator and not fluid mechanical resonances of the meniscus, Helmholtz oscillations of fluid chambers, or other resonances of the overall ink jet apparatus. The small dimensional scale of microfabricated cantilever actuators provides resonant frequencies in a range useful for the fine and ultra fine drop emitters operated by the apparatus and methods of the present invention.

SUMMARY OF THE INVENTION

It is therefore an object of the present invention to provide a liquid drop emitter which is actuated by a thermo-mechanical cantilever.

It is also an object of the present invention to provide a thermo-mechanical drop emitter to produce series and groups of droplets having substantially equal volume and velocity.

It is further an object of the present invention to provide a thermo-mechanical drop emitter using reduced input energy for some drops thereby reducing overall energy usage, managing heat build-up and allowing increased productivity of drop emission.

Yet another object of the present invention is to operate a thermo-mechanical cantilever in a damped resonant mode making advantageous use of the oscillating motion of the thermal actuator subsequent to a drop emission in order to emit a next drop using less electrical energy.

The foregoing and numerous other features, objects and advantages of the present invention will become readily apparent upon a review of the detailed description, claims and drawings set forth herein. These features, objects and advantages are accomplished by operating a liquid drop emitter for emitting a series of liquid drops having substantially uniform volume and velocity, wherein the drop emitter comprises a liquid-filled chamber having a nozzle and a thermal actuator for applying pressure to liquid at the nozzle. The thermal actuator is configured as a cantilever with a free end that is movable within the chamber. The thermal actuator exhibits a damped resonant oscillation having a fundamental period, $T_R$, and a damping time constant, $T_D$. The thermal actuator further comprises electroresistive heater means that suddenly heat the thermal actuator in response to electrical pulses. The sudden heating causes bending of the thermal actuator, the displacement of the free end, and pressurization of the liquid at the nozzle sufficient to cause drop ejection. A source of electrical pulses is connected to the liquid drop emitter and a controller means receives commands to emit drops and determines the timing and parameters of the electrical pulses which are applied to the liquid drop emitter. The method of operating comprises the steps of (a) applying to the electroresistive heating means a nominal electrical pulse having a nominal energy, $E_0$, and a nominal pulse duration, $T_{P0}$, where $T_{P0}<\frac{1}{2} T_R$ so that a nominal drop is emitted and a damped resonant oscillation of the thermal actuator is initiated. After (b) receiving a command to emit a next drop, it is determined if the thermal actuator is usefully oscillating. If not, the method returns to (a). If so, a waiting time, $T_w$, is observed until the thermal actuator is moving so as to pressurize the liquid at the nozzle. And, then, a next electrical pulse having a second energy, $E_2$, where $E_2<E_0$, and a second pulse duration, $T_{P2}$, where $T_{P2}<\frac{1}{2}T_R$, is applied to the electroresistive heating means so that a next drop having substantially the same volume and velocity as the nominal drop, is emitted. The application of reduced energy pulses is timed to reinforce the first, second, or third resonant oscillation of the thermal actuator. The amount of energy reduction accomplished depends, at least, on which resonant oscillation is useable and on the damping time constant, $T_D$.

The present invention is particularly useful for operating liquid drop emitters for DOD ink jet printing. In this embodiment, image data is organized as a series of pixels to be printed by a given jet, including many clusters of adjacent pixels. Therefore, many drop emissions will be eligible for reduced energy pulses.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides an apparatus and method of operating a drop-on-demand liquid emission device. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide apparatus and methods for operating drop emitters based on thermo-mechanical actuators so as to improve energy efficiency and overall drop emission productivity.

Figure 1:
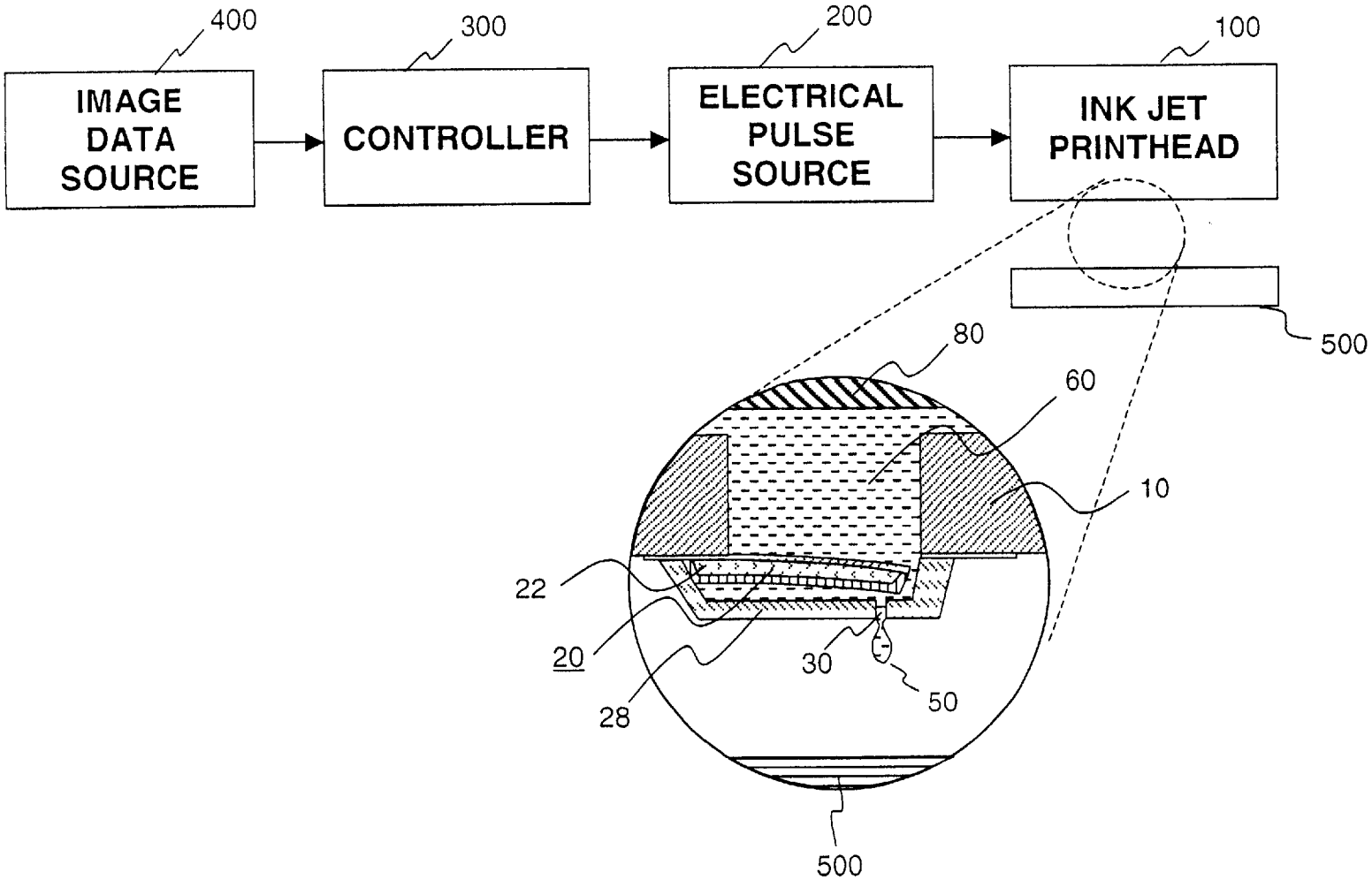
FIG. 1 is a schematic illustration of an ink jet system according to the present invention.

Turning first to FIG. 1, there is shown a schematic representation of an ink jet printing system which may be operated according to the present invention. The system includes an image data source 400 which provides signals that are received by controller 300 as commands to print drops. Controller 300 in turn makes determinations and calculations to be described in following paragraphs. Controller 300 outputs signals to a source of electrical pulses 200. Pulse source 200, in turn, generates an electrical voltage signal composed of electrical energy pulses which are applied to electroresistive means associated with each thermo-mechanical actuator 20 within ink jet printhead 100. The electrical energy pulses cause a thermo-mechanical actuator 20 (herein after "thermal actuator") to rapidly bend, pressurizing ink 60 located at nozzle 30, and emitting an ink drop 50. The present invention causes the emission of drops having substantially the same volume and velocity, that is, having volume and velocity within +/−20% of a nominal value. Some drop emitters may emit a main drop and very small trailing drops, termed satellite drops. The present invention assumes that such satellite drops are considered part of the main drop emitted in serving the overall application purpose, e.g., for printing an image pixel or for micro dispensing an increment of fluid.

Figure 2:
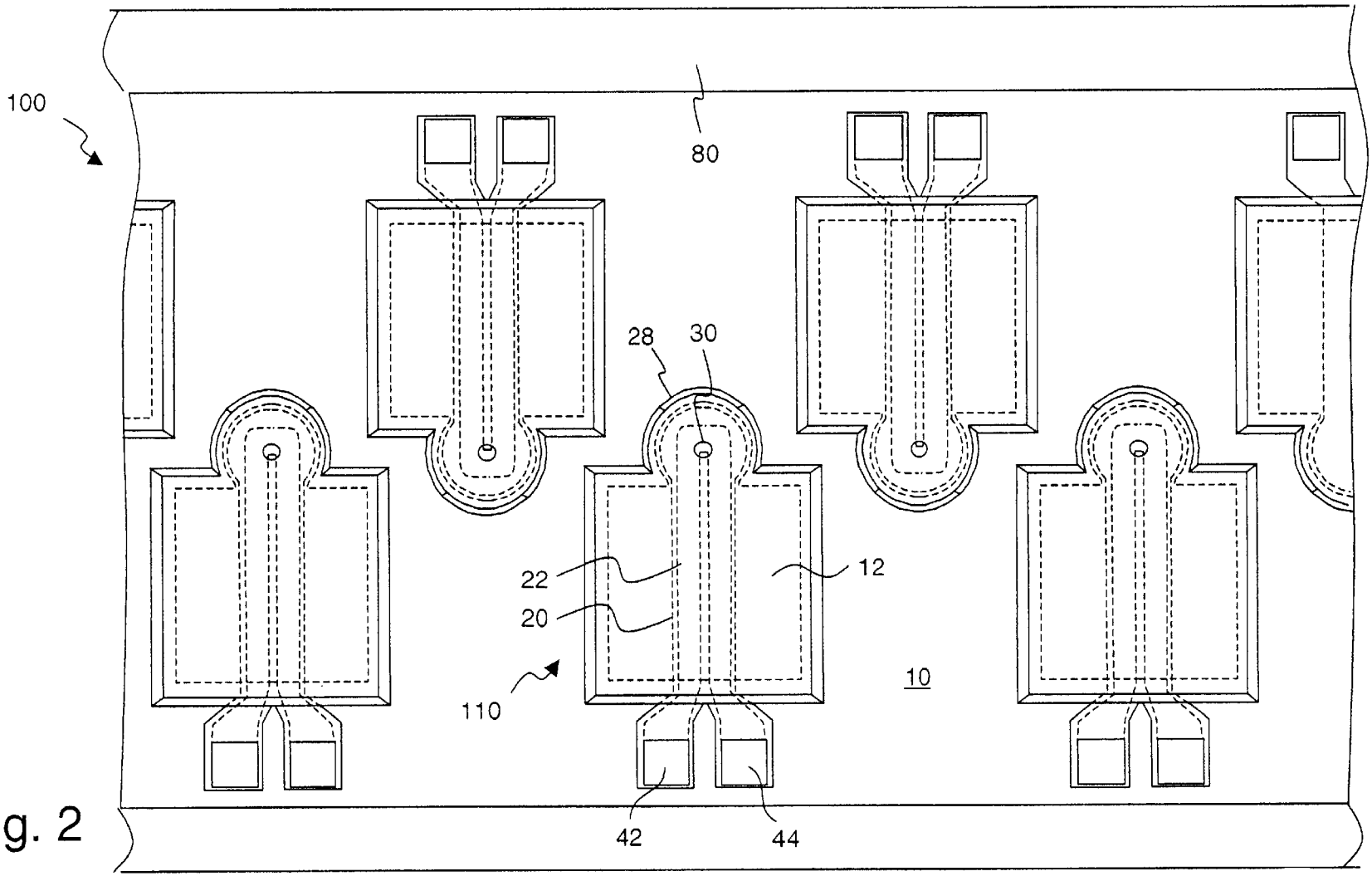
FIG. 2 is a plan view of an array of ink jet units or liquid drop emitter units according to the present invention.

FIG. 2 shows a plan view of a portion of ink jet printhead 100. An array of thermally actuated ink jet units 1 10 is shown having nozzles 30 centrally aligned, and ink chambers 12, interdigitated in two rows. The ink jet units 110 are formed on and in a substrate 10 using microelectronic fabrication methods. An example fabrication sequence which may be used to form drop emitters 110 is described in co-pending application Ser. No. 09/726,945 filed Nov. 30, 2000, for "Thermal Actuator", assigned to the assignee of the present invention.

Each drop emitter unit 110 has associated electrical lead contacts 42, 44 which are formed with, or are electrically connected to, a u-shaped electroresistive heater 22, shown in phantom view in FIG. 2. In the illustrated embodiment, the resistor 22 is formed in a layer of the thermal actuator 20 and participates in the thermo-mechanical effects which will be described. Element 80 of the printhead 100 is a mounting structure which provides a mounting surface for microelectronic substrate 10 and other means for interconnecting the liquid supply, electrical signals, and mechanical interface features.

Figure 3A:
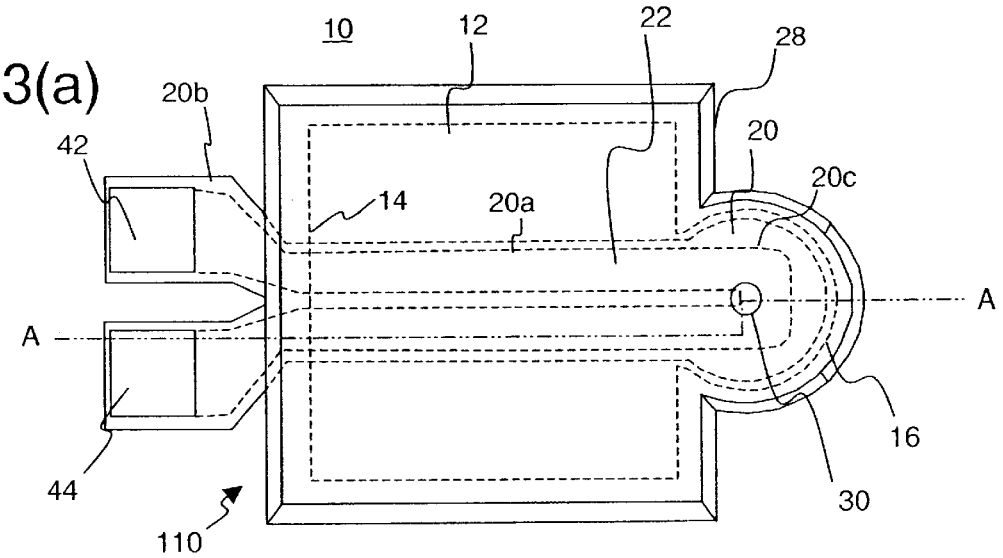
FIGS. 3(*a*) and 3(*b*) are an enlarged plan view of an individual ink jet unit shown in FIG. 2.
Figure 3B:
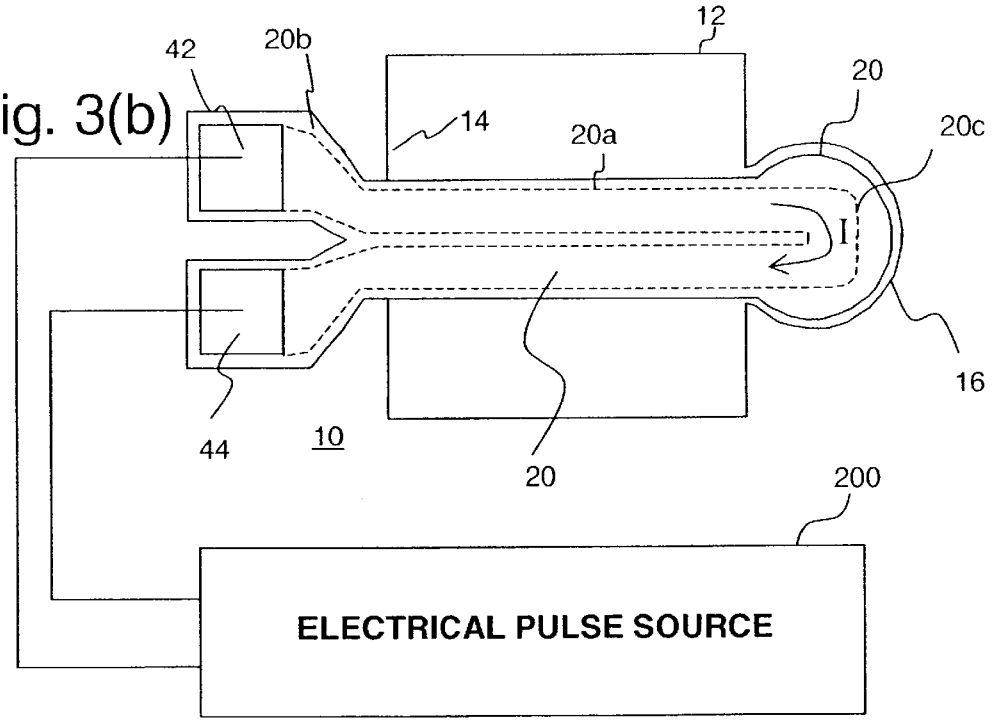

FIG. 3*a* illustrates a plan view of a single drop emitter unit 110 and a second plan view FIG. 3*b* with the liquid chamber cover 28, including nozzle 30, removed.

The thermal actuator 20, shown in phantom in FIG. 3*a* can be seen with solid lines in FIG. 3*b*. The cantilevered portion 20*a* of thermal actuator 20 extends from edge 14 of liquid chamber 12 which is formed in substrate 10. Actuator portion 20*b* is bonded to substrate 10 and anchors the cantilever.

The cantilever portion 20*a* of the actuator has the shape of a paddle, an extended flat shaft ending with a disc 20*c* of larger diameter than the shaft width. This shape is merely illustrative of cantilever actuators which can be used, many other shapes are applicable. The paddle shape aligns the nozzle 30 with the center of the actuator free end 20*c*. The fluid chamber 12 has a curved wall portion at 16 which conforms to the curvature of the actuator free end 20*c*, spaced away to provide clearance for the actuator movement.

FIG. 3*b* illustrates schematically the attachment of electrical pulse source 200 to the electroresistive heater 22 at interconnect terminals 42 and 44. Voltage differences are applied to voltage terminals 42 and 44 to cause resistance heating via u-shaped resistor 22. This is generally indicated by an arrow showing a current I. In the plan views of FIGS. 3(*a*)-3(*b*), the actuator free end 20*c* moves toward the viewer when pulsed and drops are emitted toward the viewer from the nozzle 30 in cover 28. This geometry of actuation and drop emission is called a "roof shooter" in many ink jet disclosures.

Figure 4A:
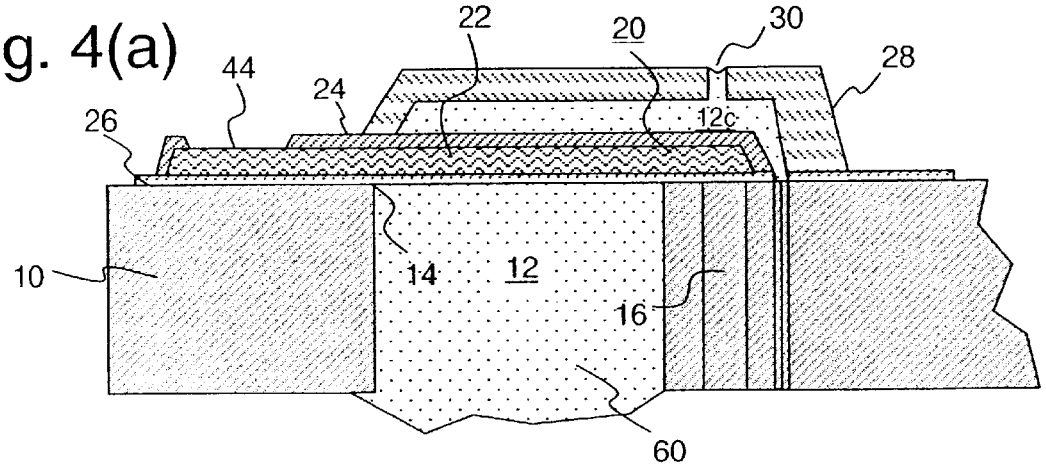
FIGS. 4(*a*)-4(*c*) are a side view of an individual ink jet unit as shown in FIGS. 2, 3(*a*) and 3(*b*) illustrating the movement of the thermal actuator to emit drops.
Figure 4B:
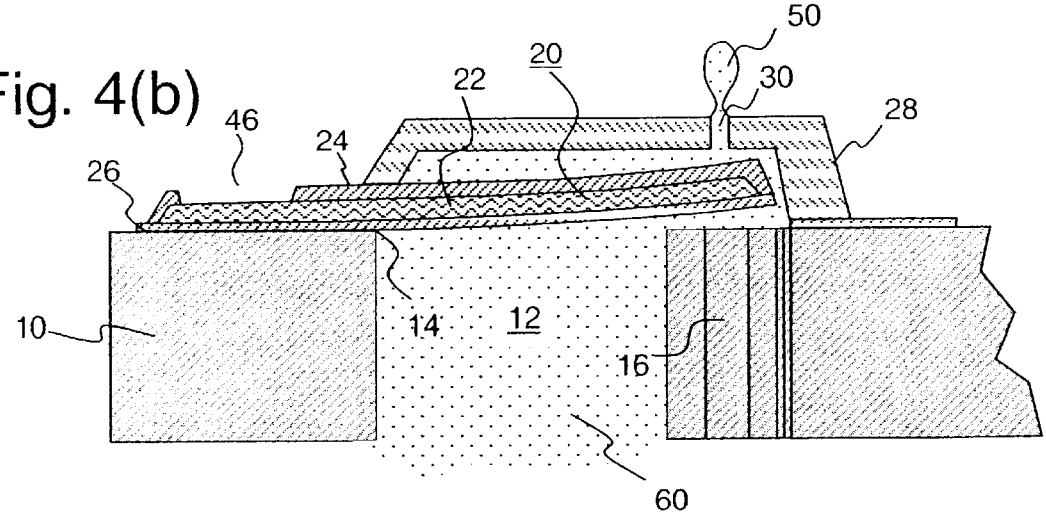
Figure 4C:
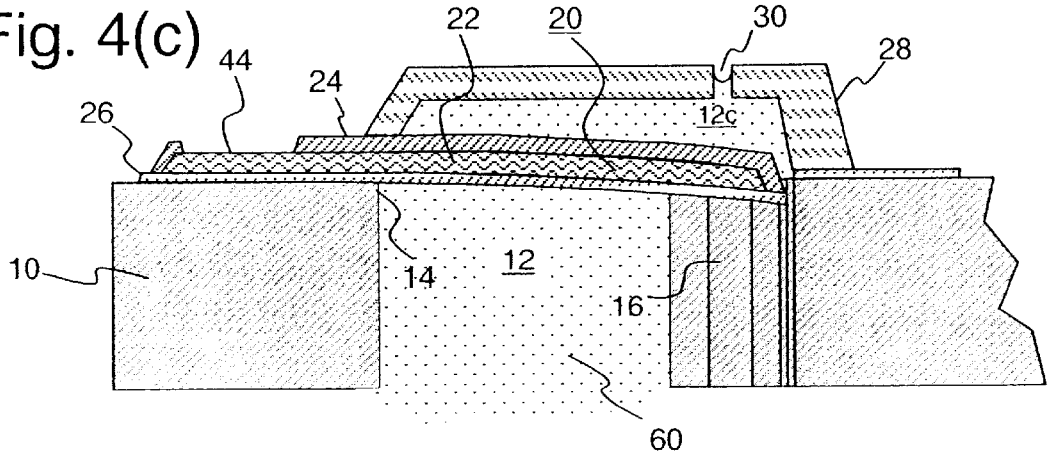

FIGS. 4(*a*)-4(*c*) show a side view along section A—A of ink jet unit device 110 in FIG. 3(*a*). FIG. 4*a* shows the thermal actuator 20 in a quiescent state. FIG. 4*b* shows actuator bent in response to thermal heating via resistor 22. FIG. 4*c* shows the actuator recoiled past the quiescent position following cessation of heating and rapid cooling.

In an operating emitter of the cantilever type illustrated, the quiescent position may be a bent position rather than the horizontal position conveyed FIG. 4*a*. The actuator may be bent upward or downward at room temperature because of internal stresses that remain after one or more microelectronic deposition or curing processes. The device may be operated at an elevated temperature for various purposes, including thermal management design and ink property control. If so, the quiescent position may be as substantially bent as is illustrated in FIG. 4*b*. And, it may be that, while being repeatedly actuated, the actuator does not cool completely leaving it quiescent and bent upward.

For the purposes of the description of the present invention herein, the actuator will be said to be "quiescent" when it is not significantly moving. For ease of understanding, the quiescent position is depicted as horizontal in FIGS. 4(*a*)-4(*c*) and plots of the displacement of the actuator show oscillations through zero in FIGS. 5, 7(*a*)-(*c*), 8, 9, 11, and 12. However, operation of thermal actuators that exhibit damped resonant oscillation about a bent quiescent position are known and anticipated by the inventors of the present invention and are fully within the scope of the present inventions.

The illustrated actuator 20 is comprised of elements 22, 24 and 26. Resistor 22 is formed from an electroresistive material having a relatively large coefficient of thermal expansion. Overlayer 24 is electrically insulating, chemically inert to the working liquid, and has a smaller coefficient of thermal expansion than has the electroresistive material forming resistor 22. Passivation layer 26 is a thin layer of material which is inert to the working liquid 60 and serves to protect heater resistor 22 from chemical or electrical contact with the working fluid 60.

An electrical pulse applied to heater resistor 22, causes it to rise in temperature and elongate. Overlayer 24 does not elongate as much causing the multilayer actuator 20 to bend upward. For this design, both the difference in thermal expansion coefficients between elements 22 and 24 and a momentary temperature differential, aids in the bending response. The electrical pulse and the bending response must be rapid enough to sufficiently pressurize the liquid at the nozzle 30 indicated generally as 12*c* in FIG. 4*a*. Typically an electrical pulse duration of less than 10 μsecs. is used and, preferably, a duration less than 4 μsecs.

The thermal actuator 20 will quickly relax from the bent position illustrated in FIG. 4*b* as elements 22 and 24 equilibrate in temperature, as heat is transferred to the working fluid and substrate 10, and due to mechanical restoring forces set up in elements 22 and 24. The relaxing thermal actuator 20 will over shoot the quiescent state and bend downwards as illustrated in FIG. 4*c*. Actuator 20 will continue to "ring" in a resonant oscillatory motion until damping mechanisms, such as internal friction and working fluid resistance, deplete and convert all residual mechanical energy to heat.

If uniform drop volume and velocities are important for the application, the damped resonant oscillation effects described above must be considered in designing the operating method. Directing drop emissions at arbitrary times during the resonant oscillations may cause drop volumes and velocities to vary unacceptably. The present invention makes beneficial use of damped resonant oscillations by appropriate timing and adjustment of electrical pulse energies.

Figure 5:
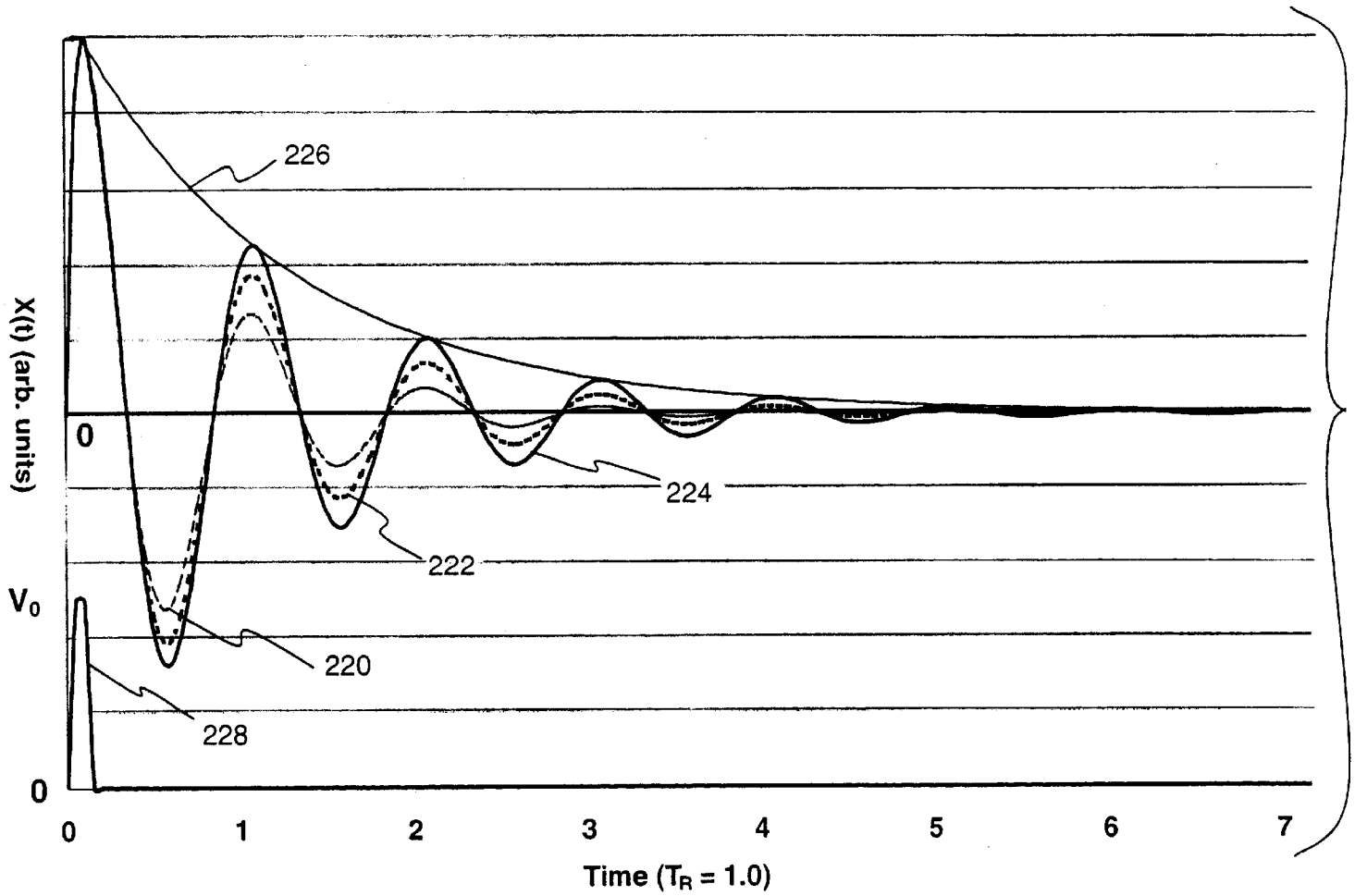
FIG. 5 illustrates damped resonant oscillation of a thermal actuator according to the present invention.

FIG. 5 illustrates, damped resonant oscillation of the free end of a cantilever actuator moving in fundamental mode. Free end displacement, X(t), is plotted as a function of time according to equation 1:

$$X(t)=\sin(2\pi t/T_R)\exp(-t/T_D) \quad (1)$$

where $T_R$ is the period of the fundamental resonant oscillation mode and $T_D$ is the time constant of damping factors. The maximum magnitude of displacement is normalized to 1.0. The time axis in FIG. 5 is divided in units of $T_R$. Curves 220, 222, and 224 show damped resonant oscillations (equation 1) all having the same resonant period $T_R$, but having damping time constant $T_D=0.75T_R$, $1.0T_R$, and $1.25T_R$, respectively. Curve 226 shows the exponential damping portion of equation 1 for the case of curve 224. Curve 228 illustrates the electrical pulse which activated the thermo-mechanical activators initially. Activation pulse duration, $T_P$, should be less than one-half the resonant period, i.e. $T_P<\frac{1}{2}T_R$, and preferably, $T_P<\frac{1}{4}T_R$, to maximize energy efficiency.

Figure 6:
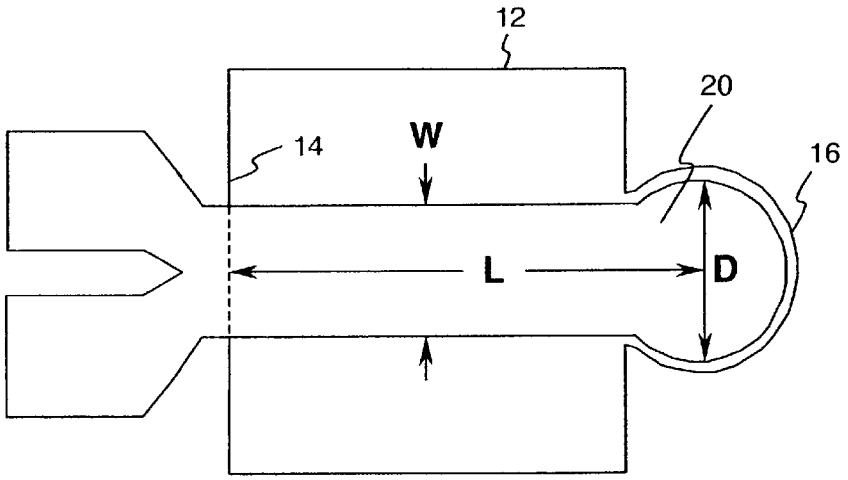
FIG. 6 illustrates geometrical parameters important to the resonant oscillation behavior of a thermal actuator and reports experimental results for the fundamental resonant periods and damping time constants for several experimental thermal actuator configurations.

FIG. 6 illustrates actuator geometrical parameters relevant to drop emitters of the design shown in FIGS. 2–4(*c*). The FIG. 6 table shows results of several experimental thermo-mechanical actuators having the paddle shape. Actuators having different widths, W, cantilever shaft lengths, L, and free end diameters, D, were operated with drop emitter devices filled with water. The FIG. 6 table gives the experimentally determined fundamental resonant frequency F, the resonant period, $T_R$, and the damping time constant, $T_D$, for the configurations tested. The ratio $T_D/T_R$ is calculated for easy comparison to the damped oscillator plots in FIG. 5. In general, the experimental thermal actuators exhibited damping time constants in the range of $T_D/T_R=0.75$, curve 220 in FIG. 5.

The resonant frequency, $T_R$, and damping time constant, $T_D$, are effected by many parameters in the design of the thermal actuator itself, the chamber wall clearances, and some fluid properties, especially density and viscosity. Most likely drop emitters operated by the present invention will have damping time constants in the range, $T_D=0.5T_R$ to $1.5T_R$.

In accordance with the present invention, drops are emitted by applying two classes of electrical pulses: (1) nominal or (2) reduced energy.

A nominal pulse energy, $E_0$, nominal pulse duration, $T_{P0}$, and nominal maximum voltage, $V_0$, are selected to be used to emit drops of a predetermined nominal volume and velocity for the working liquid and application requirements. Nominal pulses are applied to emit drops when the thermal actuator is in a quiescent state. In ink jet printing applications, the actuator will be quiescent between images, at the end of scan lines in carriage printers, and during numerous image white space areas. Consequently, many drops commanded in an ink jet application will be first (initial) drops after an absence of drop demands. Nominal energy and pulse duration electrical pulses are selected by the controller 300 to emit these print drops.

After emitting an initial drop, the thermal actuator will exhibit damped resonant oscillation as illustrated in FIG. 5. If a next drop is commanded while the actuator is still significantly ringing, this resonant oscillation can be supplemented with a reduced energy pulse to cause the emission of the commanded second drop. Depending on the timing of the second drop request and the damping time constant, useful energy saving are attainable by emitting the next drop synchronous with the first, second or third positive displacement of the actuator following the first drop emission. The fourth or higher oscillation cycle is useful provided that the actuators have sufficiently long damping time constants. However, too little actuator damping risks allowing the first oscillation to cause nozzle weeping or unintended drop emissions.

Figure 7A:
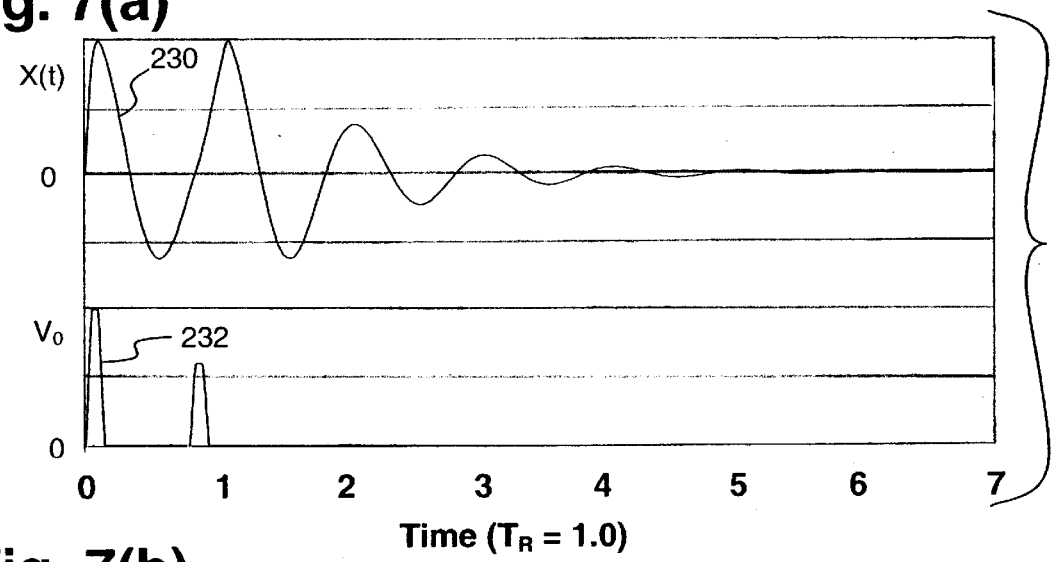
FIGS. 7(*a*)-7(*c*) illustrate the operation of the present invention in terms of the displacement of the thermal actuator to emit a series of two drops.
Figure 7B:
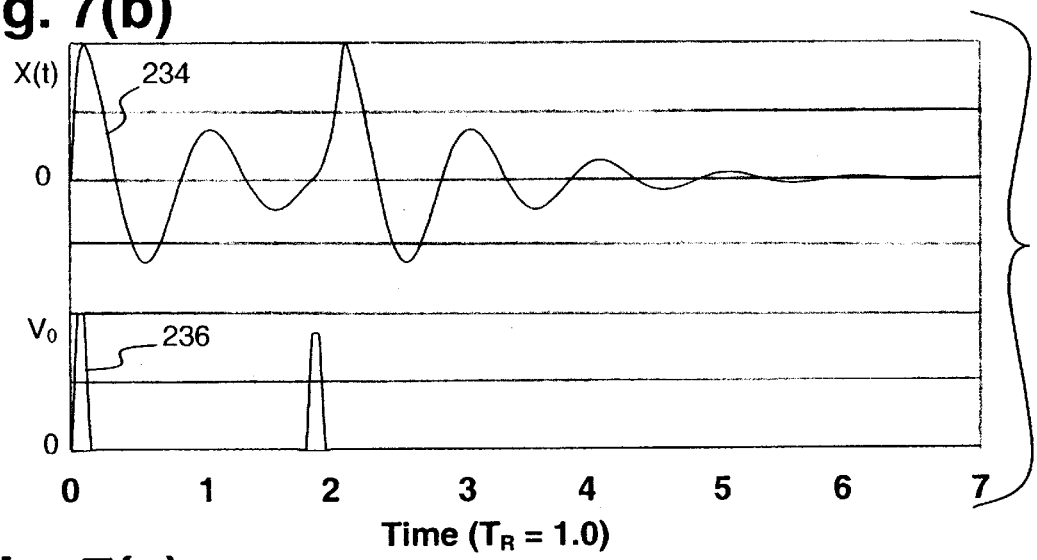
Figure 7C:
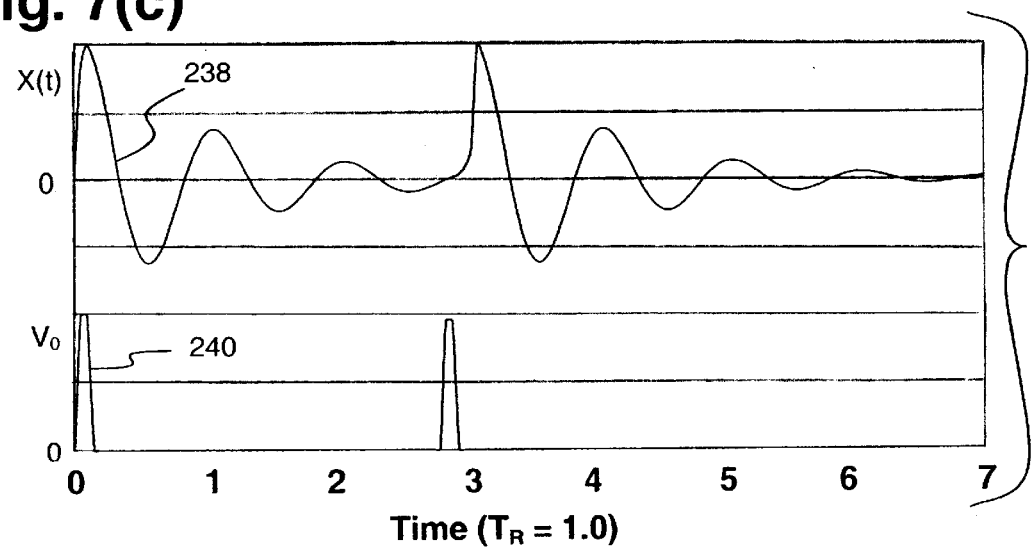

FIGS. 7(*a*)-7(*c*) illustrate the displacement of a thermal actuator free end when emitting a series of two drops. A first drop is emitted by applying a nominal energy pulse to a quiescent actuator. A second drop is then emitted using reduced energy pulses synchronized to reinforce resonant oscillations of the actuator initiated by the first pulse. FIG. 7*a* shows synchronization with the first resonant oscillation, FIG. 7*b* with the second, and FIG. 7*c* with the third. A damping time constant $T_D=1.0T_R$ is used for the examples of FIGS. 7(*a*)-(*c*).

The amount of energy reduction is indicated by the relative heights of the reduced energy pulses illustrated in FIGS. 7(*a*)-7(*c*). All of the electrical pulses have the same pulse duration, $T_P$, as the nominal pulse duration, i. e., $T_P=T_{P0}$. In the FIGS. 7(*a*)-(*c*) examples, energy reduction is implemented by maximum voltage reductions. For the damping time constant illustrated, energy reduction of about 37%, 14% and 5% is enabled when synchronized to the first, second, and third resonant oscillations, respectively. If the damping time constant were shorter, less energy would be saved at each oscillation opportunity. However, it may still be worthwhile to adjust pulse energy so as to maintain uniform drop emission volume and velocity.

Figure 8:
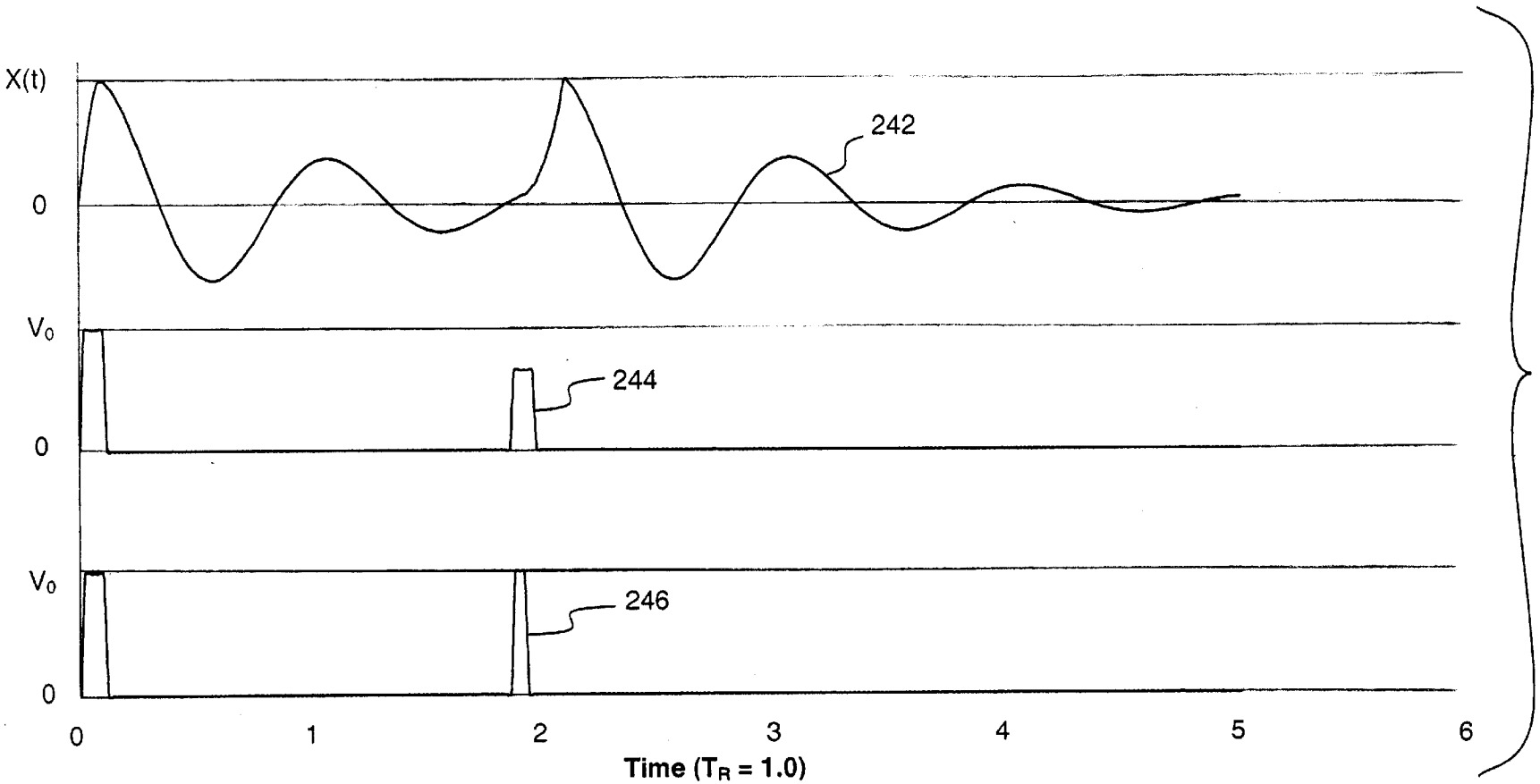
FIG. 8 illustrates two alternatives to the reduction of energy for emitting a series of two drops according to the present invention.

Energy reduction may also be implemented by pulse duration reduction, in lieu of, or together with, maximum voltage reduction. This is illustrated in FIG. 8. In this example, a second drop is emitted by a reduced energy pulse applied synchronously with the second resonant oscillation of the thermal actuator. FIG. 8 curve 242 illustrates the displacement of the free end. FIG. 8 signal 244 illustrates a reduced voltage method and FIG. 8 signal 246 shows a reduced pulse duration method for creating the two-drop emission actuator motion.

Figure 9:
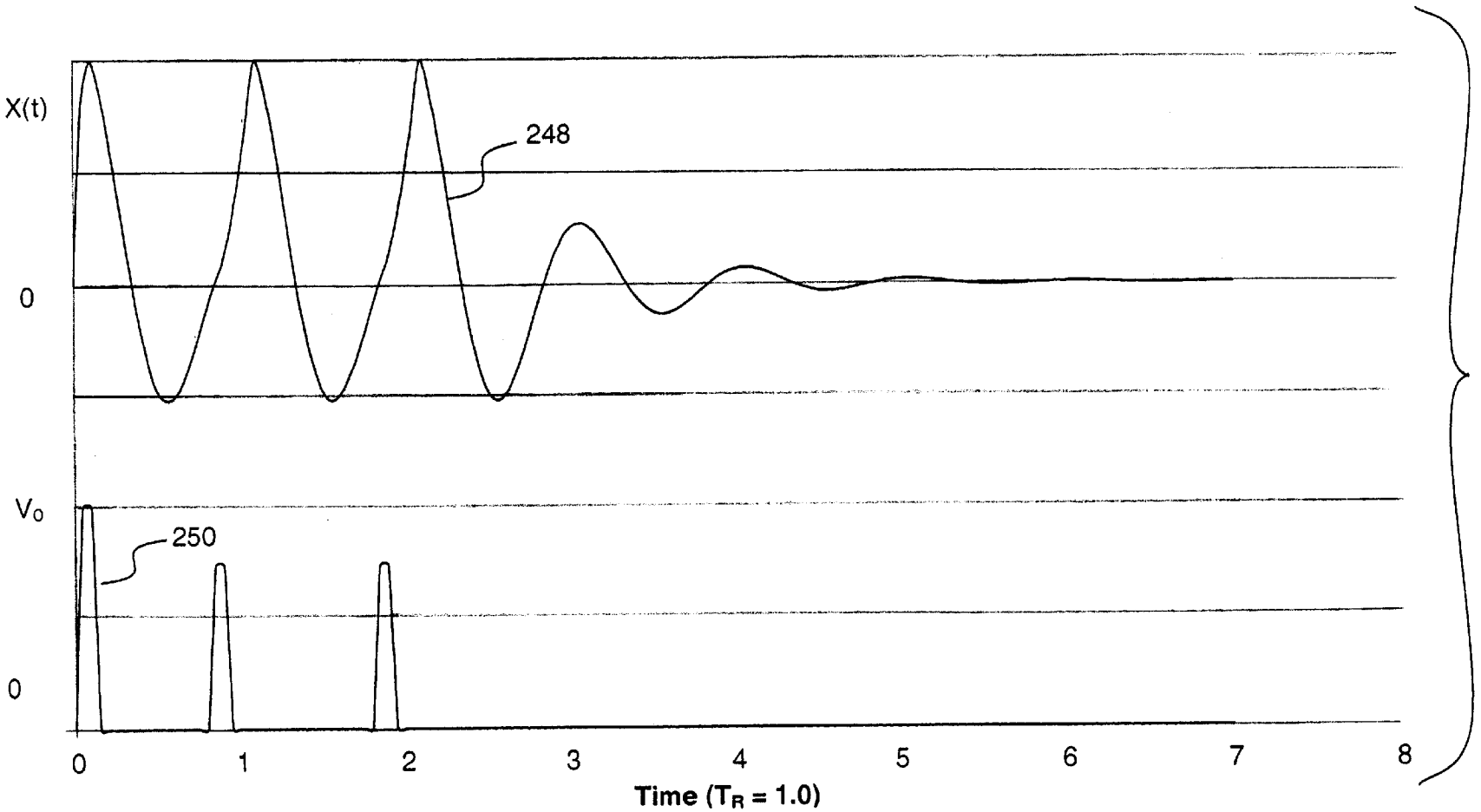
FIG. 9 illustrates the operation of the present invention in terms of the displacement of the thermal actuator to emit a series of three drops.

FIG. 9 illustrates the actuator displacement 248 associated with three drop sequence of drop emission. An initial drop is emitted by applying a nominal energy pulse (signal 250). Then, synchronous with the first resonant oscillation, a reduced energy (reduced voltage method) pulse is applied. This second pulse will re-initiate the resonant oscillation while causing the second drop emission. Then, synchronous with the first resonant oscillation following the second drop emission, a third reduced energy pulse is applied, causing the emission of a third drop.

When operating a resonating thermal actuator, as described herein, applied electrical pulses should preferably have pulse duration, $T_P$, less than one-half cycle of the fundamental resonance period, $T_R$. Longer pulses may interfere with the resonant oscillation and waste energy. The application of reinforcing, reduced energy, pulses should occur while the actuator is moving to pressurize the ink at the nozzle. This is optimally accomplished if the reduced energy pulse occurs entirely within the time during which the actuator moves between "dead bottom" and "dead top" of its travel. Pulse duration $T_P<\frac{1}{4}T_R$ is therefore preferred for more reliable synchronization.

The optimum time for applying reduced energy pulses depends on the resonance period $T_R$ and the width of the preceding electrical pulses. If the electrical pulses are relatively short compared to the resonance period then the oscillating actuator will be moving through zero displacement toward the nozzle at times $t_n \sim (n-\frac{1}{4})T_R$, for n=1, 2 or 3 for the first, second and third oscillations. The method of application of reduced energy pulses having pulse duration, $T_P<\frac{1}{4}T_R$, centered in time at times $t_n$ is a preferred embodiment of the present invention.

The present invention can be implemented with the assistance of controller 300. Controller 300 comprises clock timing means, memory means, and calculator means used to determine whether a thermal actuator is oscillating sufficiently to use a reduced energy electrical pulse. Controller 300 further comprises means for determining the parameters of any reduced energy pulses to be applied to emit a commanded drop in a series of drops, denoted, $d_i$. That is, controller 300 comprises means for determining the energy, $E_i$, the maximum voltage, $V_i$, and the pulse duration $T_{Pi}$, for the electrical pulse to be applied to emit drop, $d_i$.

Figure 10:
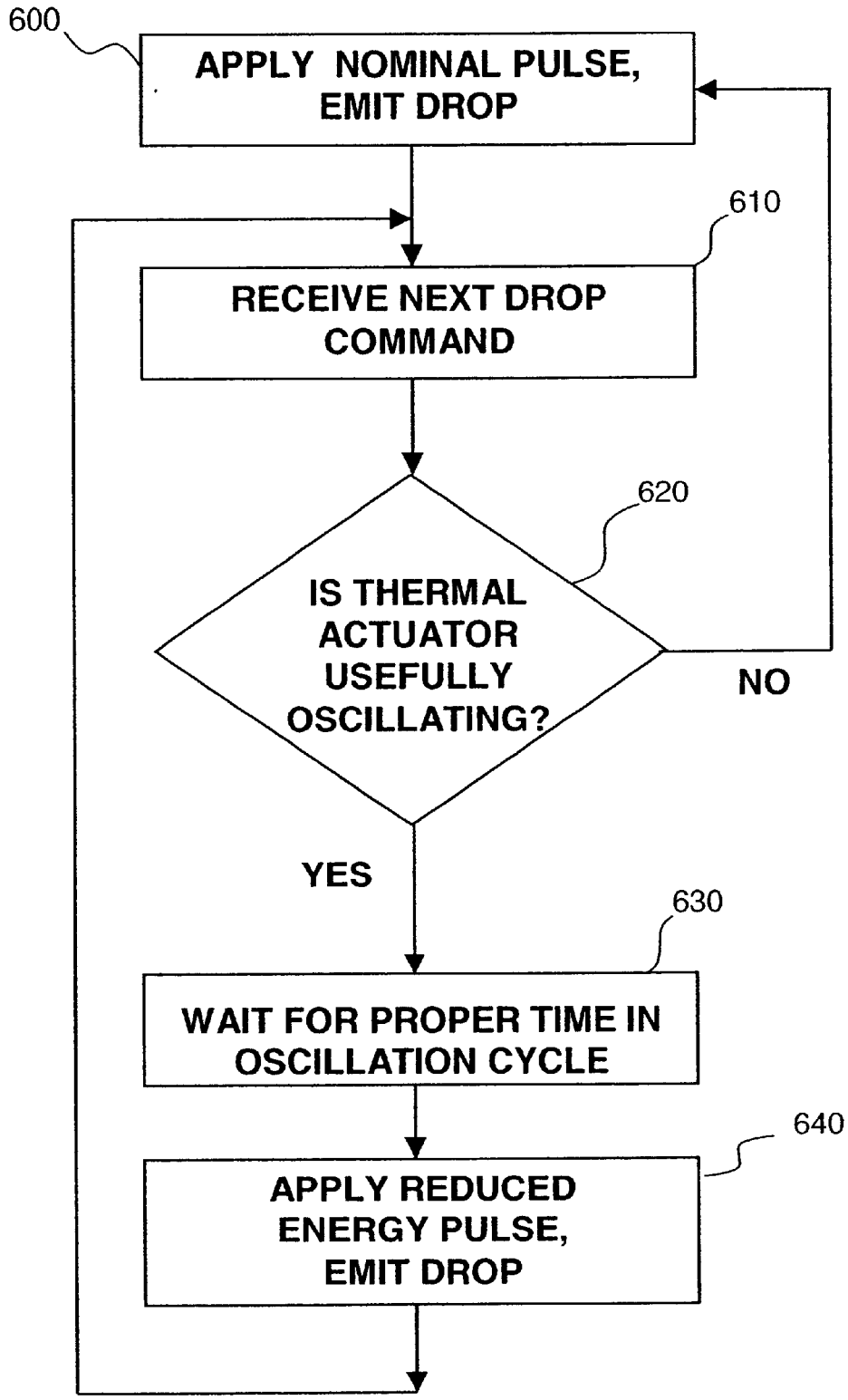
FIG. 10 illustrates by flow diagram a preferred embodiment of the present invention.

FIG. 10 shows a flow diagram of a preferred embodiment of the present invention which is implemented by a fluid drop emitter system as illustrated in FIGS. 1–4(*c*). The fluid drop emitter system comprises at least one drop emitter unit 110 within a drop emitter head 100, and a controller 300, and a source of electrical pulses 200. The embodiment diagrammed in FIG. 10 begins with the step 600 of applying to an electroresistive heater associated with a thermal actuator, a nominal electrical pulse, having a nominal energy, $E_0$, and a nominal pulse duration $T_{P0}$, where $T_{P0}<\frac{1}{2}T_R$ and, preferably, $T_{P0}<\frac{1}{4}T_R$, causing the emission of a nominal drop and initiating a damped resonant oscillation of the thermal actuator having a period, $T_R$, and a damping time constant, $T_D$.

The next step 610 of the embodiment of FIG. 10 is to receive a command to emit a next drop. For the case of an ink jet printing system, this command will be transmitted to controller 300 by an image data source 400. In another DOD application, the command may be transferred by a microdispenser system or the like.

Following receipt of a drop emission command, controller 300 executes step 620, determining if the thermal oscillator is usefully oscillating. In a preferred embodiment of this invention, the elapsed time since the last electrical pulse was applied is compared to $4T_D$. If a longer time than $4T_D$ has elapsed then the residual amplitude of free end displacement will be less than 2% and, therefore, not very much energy can be saved in the next pulse. In this embodiment, the determination is that the amount of residual oscillation is not useful for energy reduction. However, as noted earlier, in an alternate embodiment, energy reduction may be made even for such small residual oscillation to achieve optimum drop volume and velocity uniformity. If the determination, based on preset criteria, is that the residual oscillations are not useful for energy reduction, the embodiment of FIG. 10 returns to step 600, described previously.

If, instead, it is determined in step 620, that the thermal actuator is usefully oscillating, then step 630 is executed. Step 630 invokes a waiting time to synchronize the application of a reduced energy pulse to an appropriate time to reinforce one of the resonant oscillations of the thermal actuator. Which resonant oscillation can be used is dependent on when the drop emission command is received relative to the most recent previous drop emission, and on the method design. For example, a next drop command may be received immediately after a previous drop emission but the method design is to synchronize reduced energy pulses to the second resonant oscillation of the thermal actuator for reasons of overall system timing, liquid refill in the drop emitter chamber, heat dissipation, or other considerations. In a preferred embodiment of the invention, a waiting time is implemented so as to align the center of the reduced energy pulse to a time $t_n=(n-\frac{1}{4})T_R$, where n=1, 2 or 3, following the initiation of the previous electrical pulse.

At the end of the wait time implemented in step 630, step 640 is implemented. Step 640 comprises the application to the electroresistive heater means of a reduced energy pulse having energy $E_2<E_0$, and pulse duration, $T_{P2}<\frac{1}{2}T_R$, so that a next drop is emitted having substantially the same volume and velocity as the nominal drop.

Controller 300 determines the parameters of the reduced energy pulse according to predetermined method design choices. For example, a reduced voltage or a reduced pulse duration or a combination of both may be used to reduce the pulse energy. Further, the amount of energy reduction will depend on which resonant oscillation of the thermal actuator is being reinforced and on the damping time constant that is effective.

After applying the next drop electrical pulse in step 640, the embodiment of FIG. 10 returns to step 610 and awaits the reception of the next drop emission command.

An alternate embodiment of the present invention operates by establishing a drop emission clock having a period, $T_C$, based on the resonant oscillation period of the thermal actuators of a drop emission device, $T_C=T_R$. If there are multiple drop emission units, then each must have a similar fundamental period of resonant oscillation. A common drop emission clock signal is selected to provide signals sufficiently synchronous with the resonances of all of the drop emitters.

The drop emission clock, generated by a controller means, synchronizes all drop emissions. Up to one drop is permitted to be emitted from each drop emitter unit per clock period, therefore, per resonant period $T_R$, the fundamental resonance of the thermal actuators. Commands to emit drops are stored and scheduled for drop emission during an appropriate drop emission clock period. According to the present invention, the scheduling of drop emissions may be designed to allow drop emission during every first, second or third drop emission clock period, depending upon application system considerations and other factors such as liquid refill timing. A more sparse drop emission schedule is unlikely to yield meaningful energy reduction opportunities, an important objective of the present invention.

Figure 11:
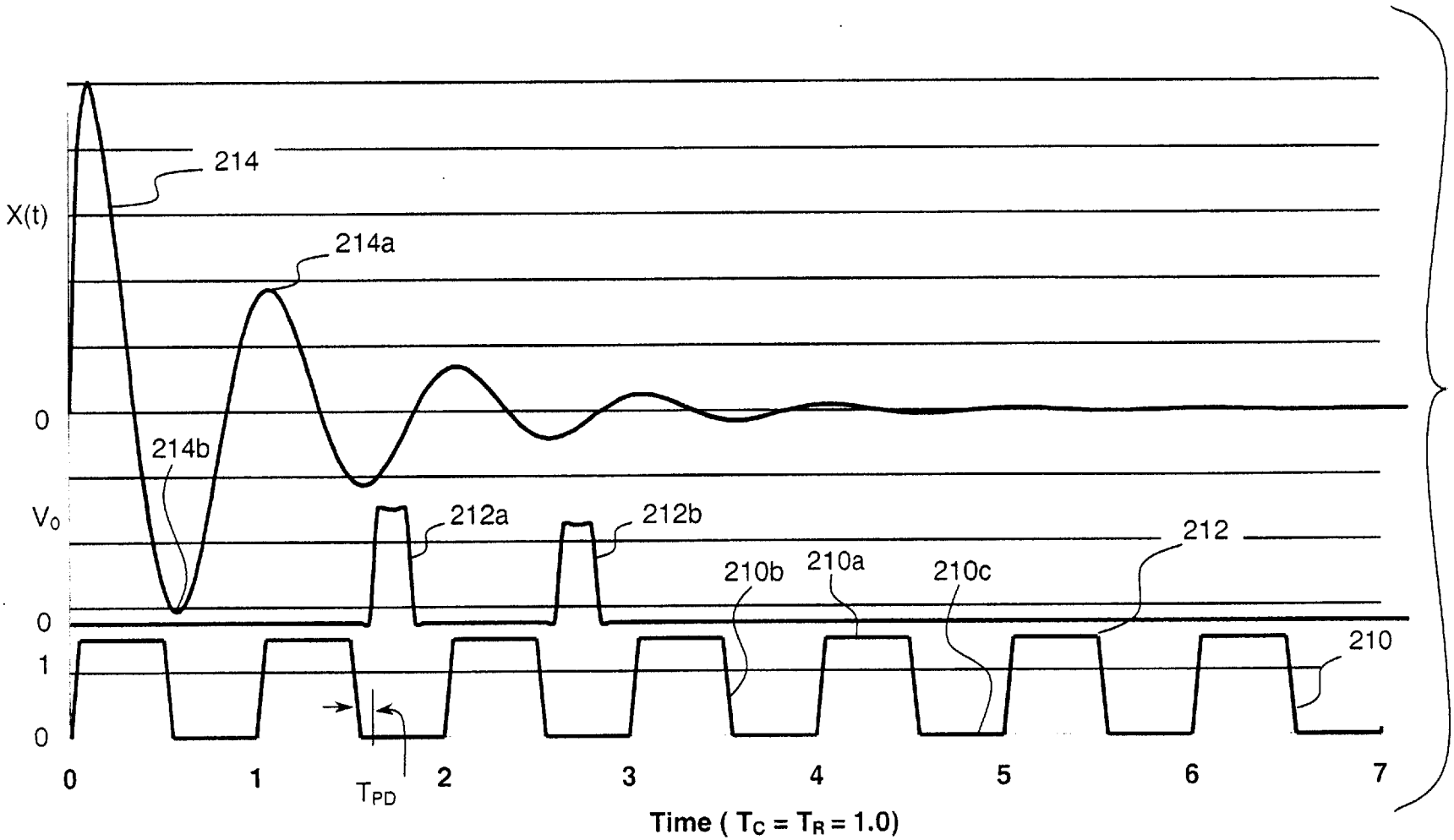
FIG. 11 illustrates the use of a drop emission clock signal to practice an embodiment of the present invention.

FIG. 11 illustrates an example drop emission clock signal 210 together with a representative damped resonant oscillator displacement plot 214 for a thermal actuator of the drop emitter. The time axis is plotted in units of $T_R$, the fundamental resonant oscillation period and the clock period, $T_C$. The drop emission clock is a square wave having transitions from logic state 1 (high) to logic state 0 (low) for each $T_C$ increment of time.

Examining the time synchronization between drop emission clock 210 and representative thermal actuator displacement plot 214 in FIG. 11, it is seen that the logic transition high-to-low (210*b*) aligns with "dead bottom" of the displacement oscillation (214*b*). As stated above, reduced energy pulses should be applied during the time when an oscillating actuator is moving from "dead bottom" (214*b*) to "dead top" (214*a*) so as to pressurize the liquid at the nozzle. Therefore, the high-to-low transition 210*b* can be used to mark the beginning of the time window during which an electrical pulse can be applied to emit a drop. All pulses, nominal and reduced energy, are applied during the logic 0 portion 210*c* of the drop emission clock The precise timing of the application of the electrical pulses may be adjusted by delaying application for an optimized time, pulse delay time, $T_{PD}$, following logic transition 210*b*. The pulse delay time, $T_{PD}$, can be predetermined based on drop emitter performance characteristics or may be adjusted during operation by a controller means. Adjustment of $T_{PD}$ during operation may be based on feedback information about system performance, environmental factors, working liquid properties, and the like. Examples of some electrical pulses to be applied to a drop emitter are illustrated by voltage signal 212. A nominal energy pulse 212*a* is indicated during emission clock period 2 and a reduced energy pulse 212*b* immediately following during emission clock period 3. Both pulses are shown as applied following a clock high-to-low transition and an additional time delay, $T_{PD}$.

Figure 12:
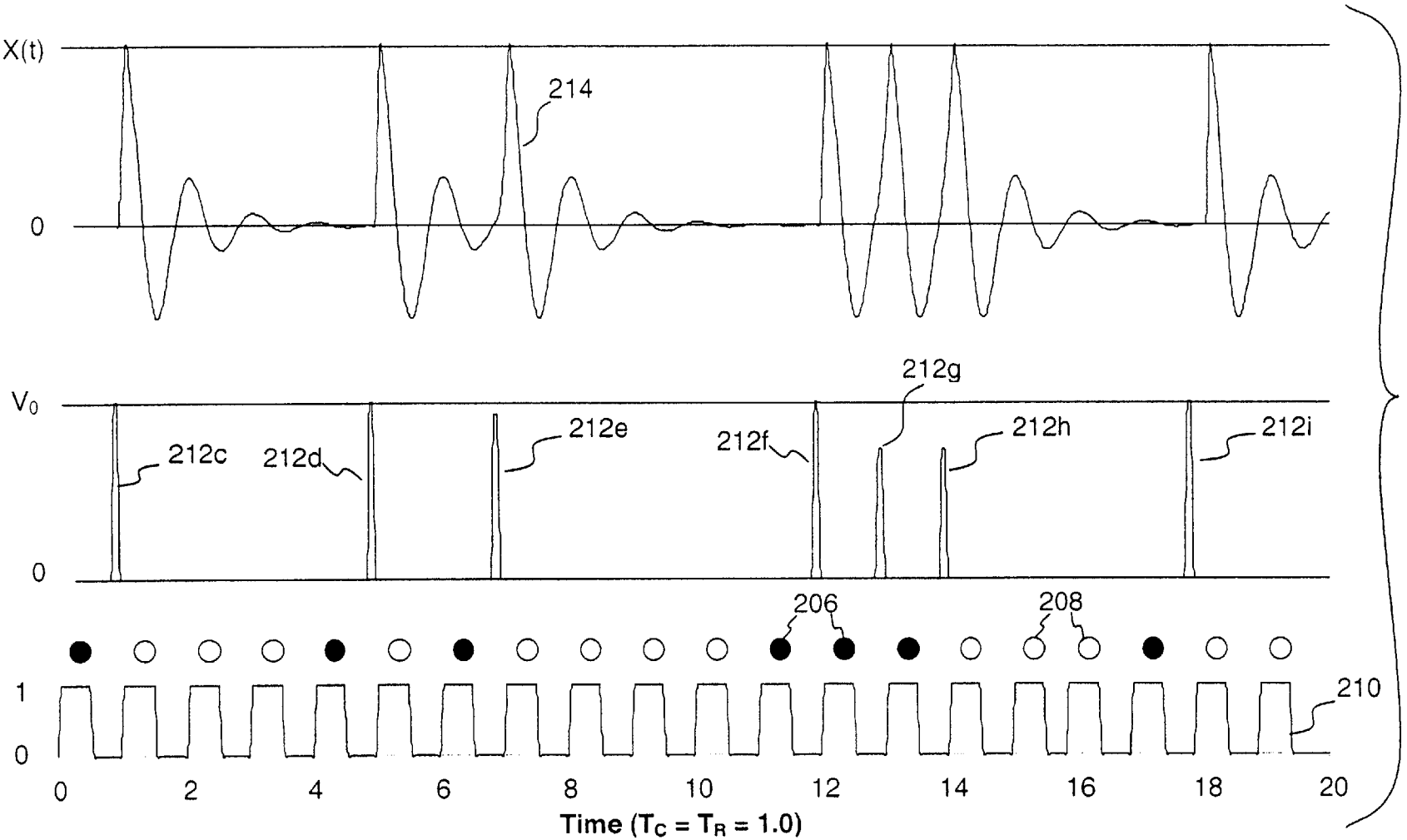
FIG. 12 illustrates the synchronization of drop emission commands, electrical pulses to energize the thermal actuator, and the displacement of the free end of the thermal actuator for a series of drop emissions.

FIG. 12 illustrates the operation of the embodiments of the present invention which use a drop emission clock. Events, signals and a representative thermal actuator free end displacement are plotted on a time axis having units of $T_R$, the fundamental resonant period of the thermal actuator. Like identifying numbers are used for like functions shown in FIG. 11. The opportunity to receive a drop command is symbolized as unfilled dots aligned with the logic high states of the drop emission clock signal, 210. Filled-in dots symbolize receipt of a command to emit a drop.

Electrical pulses, 212 are applied to the electroresistive heater means during the next logic low state of the drop emission clock, following the receipt of a command to emit drops. Pulses 212*e*, 212*g*, and 212*h* are reduced energy pulses which follow previous pulses closely enough in time to make advantageous use of resonant oscillations. More energy reduction is indicated for pulses 212*g* and 212*h* than for pulse 212*e* because the former (212*g* and 212*h*) are synchronized with first resonant oscillations whereas the latter (212*e*) is synchronized with a second resonant oscillation.

Curve 214 illustrates the displacement of the thermal actuator free end in response to the voltage pulse signal 212. For this example, the oscillator damping time constant, $T_D=0.75T_R$.

In another embodiment of the present invention, the drop emitter is operated to emit groups of drops, especially groups of one, two or three drops. Emission of groups of drops is useful in ink jet printing to provide printing density increments for very high quality images, while reducing image data storage and transmission requirements. For example, a drop emission method that provides for the emission of none, one, two or three drops can create four print density levels while requiring only two bits of binary image data. The grouping of drop emission therefore saves a factor of 2 in data storage and handling over a system wherein each drop emission is treated as an individual binary decision. Micro dispensing applications may similarly benefit from the data compression advantages of drop grouping methods.

In practice, operation of a drop emitter according to the present invention to emit groups of drops is similar to the drop emission methods previously discussed herein. Most likely, applications will impose relatively long periods of quiescence between the emission of drop groups. Thus, the first pulse of the group will be one of nominal energy, and subsequent pulses for the group, if any, will use energy reductions based on the same factors of oscillation timing and damping time constants previously discussed.

The present method of emission of groups of drops is distinctly different from prior art methods which create single drops of differing volume or drops of differing velocity to assure merging in flight or at a receiver. In the present method, drops are emitted having substantially the same volume and velocity so that they will not merge in flight or reach a receiver at the same moment. Operating in this fashion allows reduced energy pulses to be employed, reducing waste heat difficulties and promoting overall drop emission productivity.

Further, in printing applications, the individual drops of a group will land at different points on the image receiver allowing some additional optical density tuning based on the timing of two-drop emission groups. A two-drop emission can be either a first drop followed by a second at the first resonant oscillation or, alternately, at the second resonant oscillation. A somewhat different image optical density will be created by these two different two-drop patterns. In other micro drop emission applications, the times of drop landing may have other useful physical consequences.

The methods of operation of the present invention may be applied to configurations of liquid drop emitters other than those herein illustrated and discussed. For example, the liquid emitter may be co-fabricated with other microelectronic devices and structures. In particular, the controller and electrical pulse source means employed by the present invention may be micro-electronically integrated with liquid drop emitter units and arrays of emitter units.

While much of the foregoing description was directed to the operation of a single drop emitter, it should be understood that the present invention is applicable to arrays and assemblies of multiple drop emitter units. The methods of the present invention may be applied to multiple drop emitters using either common factors for energy reduction decisions and electrical pulse parameter determinations for all emitters, or individualized factors and parameters that accommodate differences among emitters.

Further, while the foregoing detailed description was directed at thermally actuated drop emitters, the present invention is applicable to any drop emitter configuration which utilizes a mechanical actuator having a damped resonant oscillation. Whether the actuating forces arise from magnetic, piezoelectric, electrostatic, thermal or other physical effects, if the actuator configuration exhibits damped resonant oscillations of useful magnitude and frequency, these oscillations may be used to advantageously reduce the energy for subsequent drop emissions as described in the present invention.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST

10 device microelectronic substrate
12 liquid chamber
12*c* liquid chamber portion at nozzle
14 liquid chamber wall edge at cantilever anchor
16 liquid chamber curved wall portion
20 thermal actuator
20*a* thermal actuator cantilever portion
20*b* thermal actuator anchor portion
20*c* thermal actuator free end portion
22 electroresistive means
26 passivation layer
28 cover plate
30 nozzle
42 electrical input pad
44 electrical input pad
50 drop
60 working fluid
80 support structure
100 ink jet printhead
110 drop emitter unit
200 electrical pulse source
300 controller
400 image data source
500 receiver

What is claimed is:

1. A method for operating a liquid drop emitter for emitting a series of liquid drops, said liquid drop emitter comprising a chamber, filled with a liquid, having a nozzle for emitting drops of the liquid, an actuator for applying pressure to the liquid at the nozzle, the actuator having a movable portion and exhibiting a damped resonant oscillation of fundamental period $T_R$ and a damping time constant $T_D$, apparatus adapted to cause rapid displacements of the movable portion of the actuator in response to electrical pulses, and a controller adapted to determine parameters of the pulses, the method for operating comprising:

(a) upon receipt of a command to emit a drop, applying an electrical pulse of energy $E_0$ and pulse duration $T_{P0}$, displacing the movable portion of the actuator so that a drop is emitted and a damped resonant oscillation of the actuator is initiated;

(b) upon receipt of a command to emit a next drop, determining if the actuator is or is not usefully oscillating;

(c) if the actuator is determined to not be usefully oscillating, returning to step (a);

(d) if the actuator is determined to be usefully oscillating, waiting a time $T_W$ until the actuator is moving so as to pressurize the liquid at the nozzle; and (e) applying an electrical pulse of energy $E_2$ and pulse duration $T_{P2}$, displacing the movable portion of the actuator so that a next drop is emitted, wherein $E_2<E_0$ and emission of the next drop advantageously uses the damped resonant oscillation of the actuator.

2. The method of claim 1 wherein the liquid drop emitter is a drop-on-demand ink jet printhead and the liquid is an ink for printing image data.

3. The method of claim 1 wherein $T_{P2}<\frac{1}{4}T_R$.

4. The method of claim 1 wherein $T_{P2}<\frac{1}{2}T_R$.

5. The method of claim 1 wherein $T_{P0}<\frac{1}{2}T_R$.

6. The method of claim 1 further comprising a step (f) of returning to step (b) after step (e).

7. The method of claim 1 wherein the determining step (c) comprises measuring an elapsed time $T_E$, since the initiation of the previous application of an electrical pulse, and finding that the actuator is not usefully oscillating if $T_E>4T_D$.

8. The method of claim 7 wherein $T_{P2}<\frac{1}{4}T_R$ and the waiting time $T_W$, is chosen so that the sum of $(T_W+T_E+\frac{1}{2}T_{P2})$ is approximately equal to $(n-\frac{1}{4})T_R$, where n is a chosen integer $\geqq 1$.

9. A liquid drop emitter for emitting a series of liquid drops, said liquid drop emitter comprising:

a chamber, filled with a liquid, having a nozzle for emitting drops of the liquid;

an actuator for applying pressure to the liquid at the nozzle, the actuator having a moveable portion within the chamber and exhibiting a damped resonant oscillation of fundamental period $T_R$ and a damping time constant $T_D$;

apparatus adapted to cause rapid displacements of the movable portion of the actuator in response to electrical pulses; and a controller adapted to determine parameters of the pulses according to the method set forth in claim 1.

10. A method for operating a liquid drop emitter for emitting a series of liquid drops having substantially uniform volume and velocity, said liquid drop emitter comprising a chamber, filled with a liquid, having a nozzle for emitting drops of the liquid, an actuator for applying pressure to the liquid at the nozzle, the actuator having a moveable portion within the chamber and exhibiting a damped resonant oscillation of fundamental period $T_R$ and a damping time constant $T_D$, apparatus adapted to cause rapid displacements of the movable portion of the actuator in response to electrical pulses, and a controller adapted to determine parameters of the pulses, the method for operating comprising:

(a) upon receipt of a command to emit a drop, applying a nominal electrical pulse of energy $E_0$ and pulse duration $T_{P0}$, displacing the movable portion of the actuator so that a nominal drop is emitted and a damped resonant oscillation of the actuator is initiated;

(b) upon receipt of a command to emit a next drop, determining if the actuator is or is not usefully oscillating;

(c) if the actuator is determined to not be usefully oscillating, returning to step (a);

(d) if the actuator is determined to be usefully oscillating, waiting a time $T_W$ until the actuator is moving so as to pressurize the liquid at the nozzle; and (e) applying a next electrical pulse of energy $E_2$ and pulse duration $T_{P2}$, displacing the movable portion of the actuator so that a next drop is emitted having substantially the same volume and velocity as the nominal drop, wherein $E_2<E_0$ and emission of the next drop advantageously uses the damped resonant oscillation of the actuator.

11. The method of claim 10 wherein the liquid drop emitter is a drop-on-demand ink jet printhead and the liquid is an ink for printing image data.

12. The method of claim 10 wherein $T_{P2}<\frac{1}{4}T_R$.

13. The method of claim 10 wherein $T_{P0}<\frac{1}{2}T_R$.

14. The method of claim 10 wherein the nominal electrical pulse has a maximum voltage, $V_0$, and the next electrical pulse, having an energy $E_2$, has a maximum voltage $V_2$, and $V_2<V_0$.

15. The method of claim 10 wherein the nominal electrical pulse has a maximum voltage, $V_0$, and the next electrical pulse, having an energy $E_2$, has a maximum voltage, $V_2$, substantially equal to $V_0$, and the second pulse duration $T_{P2}$ is less than $T_{P0}$.

16. The method of claim 10 wherein the determining step (c) comprises measuring an elapsed time, $T_E$, since the initiation of the previous application of an electrical pulse, and finding that the actuator is not usefully oscillating if $T_E>4T_D$.

17. A liquid drop emitter for emitting a series of liquid drops, said liquid drop emitter comprising:

a chamber, filled with a liquid, having a nozzle for emitting drops of the liquid;

a thermal actuator having a movable portion and exhibiting a damped resonant oscillation of fundamental period, $T_R$, and damping time constant, $T_D$;

means for heating the thermal actuator so as to cause rapid displacement in response to electrical pulses;

a source of electrical pulses for applying energy to the heating means; and controller means for determining parameters of the electrical pulses according to the method set forth in claim 16.

18. A liquid drop emitter for emitting a series of liquid drops having substantially uniform volume and velocity, said liquid drop emitter comprising:

a chamber, filled with a liquid, having a nozzle for emitting drops of the liquid;

an actuator for applying pressure to the liquid at the nozzle, the actuator having a moveable portion within the chamber and exhibiting a damped resonant oscillation of fundamental period $T_R$ and a damping time constant $T_D$;

apparatus adapted to cause rapid displacements of the movable portion of the actuator in response to electrical pulses; and a controller adapted to determine parameters of the pulses according to the method set forth in claim 10.

19. A method for operating a liquid drop emitter for emitting a series of liquid drops having substantially uniform volume and velocity, said liquid drop emitter comprising a chamber, filled with a liquid, having a nozzle for emitting drops of the liquid, a thermal actuator for applying pressure to the liquid at the nozzle, the thermal actuator having a movable portion and exhibiting a damped resonant oscillation of fundamental period, $T_R$, and damping time constant, $T_D$, means for heating the thermal actuator so as to cause rapid displacement in response to electrical pulses, a source of electrical pulses for applying energy to the heating means, and controller means for determining parameters of the electrical pulses, the method for operating comprising:

(a) upon receipt of a command to emit a drop, applying a nominal electrical pulse of energy $E_0$ and pulse duration $T_{P0}$, displacing the movable portion of the thermal actuator so that a nominal drop is emitted and a damped resonant oscillation of the thermal actuator is initiated;

(b) upon receipt of a command to emit a next drop, determining if the thermal actuator is or is not usefully oscillating;

(c) if the thermal actuator is determined to not be usefully oscillating, returning to step (a);

(d) if the thermal actuator is determined to be usefully oscillating, waiting a time $T_W$ until the thermal actuator is moving so as to pressurize the liquid at the nozzle; and (e) applying a next electrical pulse of energy $E_2$ and pulse duration $T_{P2}$, displacing the movable portion of the thermal actuator so that a next drop having substantially the same volume and velocity as the nominal drop is emitted, wherein $E_2<E_0$ and emission of the next drop advantageously uses the damped resonant oscillation of the actuator.

20. The method of claim 19 wherein the liquid drop emitter is a drop-on-demand ink jet printhead and the liquid is an ink for printing image data.

21. The method of claim 19 wherein $T_{P2}<\frac{1}{4}T_R$.

22. The method of claim 19 wherein $T_{P0}<\frac{1}{2}T_R$.

23. The method of claim 19 wherein the thermal actuator is configured as a cantilever having a free end movable within the chamber.

24. The method of claim 19, wherein the means for heating comprises an electroresistive element.

25. The method of claim 19 wherein the nominal electrical pulse has a maximum voltage, $V_0$, and the next electrical pulse, having an energy $E_2$, has a maximum voltage $V_2$, and $V_2<V_0$.

26. The method of claim 19 wherein the nominal electrical pulse has a maximum voltage, $V_0$, and the next electrical pulse, having an energy $E_2$, has a maximum voltage, $V_2$, substantially equal to $V_0$, and the second pulse duration $T_{P2}$ is less than $T_{P0}$.

27. The method of claim 19 wherein the determining step (b) comprises measuring an elapsed time, $T_E$, since the initiation of the previous application of an electrical pulse, and finding that the thermal actuator is not usefully oscillating if $T_{Eb>4}T_D$.

28. The method of claim 27 wherein $T_{P2}<\frac{1}{4}T_R$ and the waiting time, $T_W$, is chosen so that the sum of $(T_W+T_E+\frac{1}{2}T_{P2})$ is approximately equal to $(n-\frac{1}{4})T_R$, where n is a chosen integer$\geqq 1$.

29. The method of claim 28 further comprising a calculating step, following waiting step (d) and preceding applying step (e), said calculating step comprising calculating a second energy, $E_2$, for a next electrical pulse, wherein $E_2$ depends, at least, on the value of n chosen in waiting step (d).

30. The method of claim 29 wherein the nominal electrical pulse has a maximum voltage, $V_0$, and the next electrical pulse, having a second energy, $E_2$, has a maximum voltage $V_2$, substantially equal to $V_0$, and the second pulse duration $T_{P2}$ is less than the nominal pulse duration $T_{P0}$.

31. A method for operating a liquid drop emitter for emitting a series of liquid drops having substantially uniform volume and velocity, said liquid drop emitter comprising a chamber, filled with a liquid, having a nozzle for emitting drops of the liquid, a thermal actuator for applying pressure to the liquid at the nozzle, the thermal actuator having a movable portion and exhibiting a damped resonant oscillation of fundamental period, $T_R$, and damping time constant, $T_D$, means for heating the thermal actuator so as to cause rapid displacement in response to electrical pulses, a source of electrical pulses for applying energy to the heating means, and controller means for determining parameters of the electrical pulses and generating timing signals, the method for operating comprising:

(a) determining a nominal energy, $E_0$, and a nominal pulse duration, $T^{P0}$, to be used to emit a nominal drop when the thermal actuator is in a quiescent state;

(b) generating a drop emission clock having a period $T_C$, where $T_C=nT_R$ and n is an integer number=1, 2, or 3, for synchronizing applied electrical pulses to reinforce damped resonant oscillations of the thermal actuator;

(c) receiving and storing commands to emit a series of drops, denoted $d_i$;

(d) synchronizing commands to emit drops to the drop emission clock, wherein one drop may be emitted per drop emission clock period, $T_C$, and each emitted drop has an emission clock time;

(e) reducing the energy of the electrical pulse, $E_i$, to be used to eject drop $d_i$, based, at least, on preceding drop emissions, so that $E_i<E_0$ if drop emissions will occur during a preceding time, $mT_C$, where m is an integer such that $mT_C<4T_D$; and (f) applying to the heating means an electrical pulse having energy, $E_i$, and a pulse duration, $T_{Pi}$, where $T_{Pi}<\frac{1}{4}T_R$, to emit drop $d_i$, having substantially the same volume and velocity as a nominal drop, wherein emission of the drop $d_i$ may be accomplished using less energy than $E_0$ by advantageously reinforcing the damped resonant oscillation of the thermal actuator initiated by preceding drop emissions.

32. The method of claim 31 wherein the liquid drop emitter is a drop-on-demand ink jet printhead and the liquid is an ink for printing image data.

33. The method of claim 31 wherein $T_{P0}<\frac{1}{2}T_R$.

34. The method of claim 31 wherein the thermal actuator is configured as a cantilever having a free end movable within the chamber.

35. The method of claim 31 wherein the means for heating comprises an electroresistive element.

36. The method of claim 31 wherein the nominal electrical pulse has a maximum voltage $V_0$, the electrical pulse to be used to emit drop $d_i$ has an energy, $E_i$, and a maximum voltage, $V_i$, and the reducing energy step (e) operates by reducing the maximum voltage, $V_i$, so that $V_i<V_0$ and $T_{Pi}=T_{P0}$.

37. The method of claim 31 wherein the nominal electrical pulse has a maximum voltage $V_0$, the electrical pulse to be used to emit drop $d_i$ has an energy, $E_i$, and a maximum voltage, $V_i$, and the reducing energy step (e) operates by reducing the pulse duration, $T_{Pi}$, so that $T_{Pi}<T_{P0}$ and $V_i=V_0$.

38. The method of claim 31 wherein the reducing step (e) reduces the energy, $E_i$, to be used to emit drop $d_i$, based on, at least, the emission clock times of drops emitted during the preceding time, $mT_C$.

39. A liquid drop emitter for emitting a series of liquid drops, said liquid drop emitter comprising:

a chamber, filled with a liquid, having a nozzle for emitting drops of the liquid;

a thermal actuator having a movable portion and exhibiting a damped resonant oscillation of fundamental period, $T_R$, and damping time constant, $T_D$;

means for heating the thermal actuator so as to cause rapid displacement in response to electrical pulses.

a source of electrical pulses for applying energy to the heating means; and controller means for determining parameters of the electrical pulses and generating timing signals according to the method set forth in claim 31.

40. A method for operating a liquid drop emitter for emitting a series of liquid drops having substantially uniform volume and velocity, said liquid drop emitter comprising a chamber, filled with a liquid, having a nozzle for emitting drops of the liquid, a thermal actuator for applying pressure to the liquid at the nozzle, the thermal actuator having a movable portion and exhibiting a damped resonant oscillation of fundamental period, $T_R$, and damping time constant, $T_D$, means for heating the thermal actuator so as to cause rapid displacement in response to electrical pulses, a source of electrical pulses for applying energy to the heating means, and controller means for determining parameters of the electrical pulses, the method for operating comprising:

(a) applying to the electroresistive heating means a first electrical pulse having a first energy, $E_1$, and a first pulse duration, $T_{P1}$, so that a first drop is emitted and a damped resonant oscillation of the thermal actuator is initiated; and, then, (b) suspending application of electrical pulses for a first waiting time, $T_{W1}$, so that the free end of the oscillating thermal actuator is moving to pressurize the liquid at the nozzle subsequent to the emission of the first drop; and, then, (c) applying to the electroresistive heating means a second electrical pulse having a second energy, $E_2$, where $E_2<E_1$, and a second pulse duration, $T_{P2}$, so that a second drop, having substantially the same volume and velocity as the first drop is emitted, wherein emission of the second drop requires the application of less energy than the first drop by advantageously using the damped resonant oscillation of the thermal actuator.

41. The method of claim 40 wherein the liquid drop emitter is a drop-on-demand ink jet printhead and the liquid is an ink for printing image data.

42. The method of claim 40 wherein $T_{P1}<\frac{1}{2}T_R$ and $T_{P2}<\frac{1}{2}T_R$.

43. The method of claim 40 wherein the thermal actuator is configured as a cantilever having a free end movable within the chamber.

44. The method of claim 40 wherein the means for heating comprises an electroresistive element.

45. The method of claim 40 further comprising the steps:

(d) suspending application of electrical pulses for a second waiting time, $T_{W2}$, so that the free end of the oscillating thermal actuator is moving to pressurize the liquid at the nozzle subsequent to the emission of the second drop; then, (e) applying to the electroresistive heating means a third electrical pulse having a third energy, $E_3$, where $E_3<E_1$, and a third pulse duration, $T_{P3}$, so that a third drop, having substantially the same volume and velocity as the first drop is emitted, wherein emission of the third drop requires the application of less energy than the first drop by advantageously using the damped resonant oscillation of the thermal actuator.

46. The method of claim 45 wherein the pulse energies $E_1$, $E_2$, and $E_3$ are substantially equal, and pulse duration $T_{P2}$ and $T_{P3}$ are less than pulse duration $T_{P1}$.

47. The method of claim 45 wherein the pulse duration $T_{P1}$, $T_{P2}$, $T_{P3}$ are substantially equal, and pulse energies $E_2$, and $E_3$ are less than pulse energy $E_1$.

48. A liquid drop emitter for emitting a series of liquid drops, said liquid drop emitter comprising:

a chamber, filled with a liquid, having a nozzle for emitting drops of the liquid;

a thermal actuator having a movable portion and exhibiting a damped resonant oscillation of fundamental period, $T_R$, and damping time constant, $T_D$;

means for heating the thermal actuator so as to cause rapid displacement in response to electrical pulses;

a source of electrical pulses for applying energy to the heating means; and controller means for determining parameters of the electrical pulses according to the method set forth in claim 40.

* * * * *